US006257475B1

(12) United States Patent
Ishii et al.

(10) Patent No.: US 6,257,475 B1
(45) Date of Patent: Jul. 10, 2001

(54) APPARATUS FOR ISSUING A TICKET

(75) Inventors: Ryuji Ishii, Takasaki; Sadao Sone; Ikuo Suto, both of Tokyo, all of (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/095,659

(22) Filed: Jun. 11, 1998

(30) Foreign Application Priority Data

Jun. 11, 1997 (JP) ..... 9-153916

(51) Int. Cl.[7] ..... B26F 3/00
(52) U.S. Cl. ..... 225/100; 225/93
(58) Field of Search ..... 225/100, 4, 93, 225/97

(56) References Cited

U.S. PATENT DOCUMENTS 4,618,085 * 10/1986 Kimura et al. ..... 225/100

FOREIGN PATENT DOCUMENTS 9-067061 3/1997 (JP) .

* cited by examiner

*Primary Examiner*—Lee Young
(74) *Attorney, Agent, or Firm*—Venable; Robert J. Frank

(57) ABSTRACT

An apparatus for separating a ticket from a ticket sheet containing a plurality of tickets, each of the tickets being separated from an adjacent ticket by a line of perforations. The apparatus includes a cutting part having a feed passage, first and second spaced feed rollers positioned within the cutting part for conducting the ticket sheet along the feed passage, and a cutting roller positioned within the cutting part between the first and second feed rollers for cutting a ticket sheet at the line of perforations. The cutting roller includes an axle and a surface having first and second ends surrounding a length of the axle. The surface of the cutting roller includes a central portion having a first diameter forming a first cutting edge on a circumference thereof, and further includes first and second outer portions. The first outer portion is located between the first end of the surface and the central portion, and the second outer portion is located between the second end of the surface and the central portion. Each of the first and second outer portions has a second diameter which is less than the first diameter and forms a second cutting edge which is smaller than the first cutting edge. A driver is provided for driving the first and second feed rollers at predetermined speeds to bring a line of perforations on the ticket sheet into engagement with the cutting edges of the cutting roller, and a controller is coupled to the driver for controlling the speed at which each of the feed rollers is driven. The feed rollers are driven at different speeds so that parts of the ticket sheet on opposite sides of the line of perforations are pulled in opposite directions while the line of perforations is cut by the cutting edges of the cutting roller thereby separating a ticket from the ticket sheet.

11 Claims, 8 Drawing Sheets

APPARATUS FOR ISSUING A TICKET

BACKGROUND OF THE INVENTION

The present invention relates to an apparatus and a method for issuing a ticket of the type used to identify a person entitled to board a plane, ship or train. More particularly, it relates to an apparatus for removing a ticket from an elongated rectangular ticket sheet consisting of a plurality of tickets separated by perforations, and issuing the ticket to a purchaser.

An apparatus for cutting a ticket from such a ticket sheet and issuing it is disclosed in Japanese patent application number 7-223348 (Publication number 9-67061 published Mar. 11, 1997) and shown in FIG. 7. Referring to FIG. 7, an elongated rectangular ticket sheet 1 is illustrated which consists of a plurality of tickets 3, 3', 3" connected end-to-end by transverse lines of perforations 2, 2' which permit each ticket to be separated from the ticket sheet 1 for conveyance to a customer. In this prior art apparatus, the ticket sheet 1 is fed by a first feed means 30 along a feed passage (not shown) to a cutting part 400 of the apparatus. A second feed means 50 is positioned downstream from the cutting part 400, and a cutting roller 500 is interposed between the first and second feed means 30 and 50 at the cutting part 400. The feed means 30 and 50 are rotated at different speeds, the rotational speed of feed means 50 being greater than that of feed means 30.

The cutting roller 500, which is shaped somewhat like a bead of an abacus, consists of an axle 510 and a surface 520 formed of two conical portions 520*a* and 520*b* having a common base 520*c* at the center thereof. The circumferential surface of the common base 520*c* forms the cutting edge of the cutter roller 500. The base 520*c* has a greater diameter than the remainder of the surface 520 of roller 500, and functions as the cutting portion of the roller.

In operation, the leading edge 1' of the ticket sheet 1 is inserted in feed means 30 and conveyed by rotation of feed means 30 to the feed means 50. When the leading edge 1' of ticket sheet 1 reaches the feed means 50, rotation of feed means 30 is stopped, rotation of feed means 50 is started, and the leading edge 1' of ticket sheet 1 is conveyed by rotation of feed means 50 to the position shown in FIG. 7. When the line of perforations 2 separating ticket 3 from ticket 3' reaches the cutting roller 500, rotation of feed means 30 is restarted at a slower rotational speed than that of feed means 50. Because the rotational speed of feed means 50 is greater than the rotational speed of feed means 30, and because the perforations 2 of ticket sheet 1 are pressed against the cutting roller 500, the ticket sheet 1 is stretched around the perforations 2 from both sides.

The cutting edge at common base 520*c* of the cutting roller 500 makes a shallow cut in the perforations 2 and a small diamond-shaped opening is formed in the center of the perforations. As the power for pulling the ticket sheet 1 is further increased, the diamond-shaped opening is ripped along the perforations 2 and the diamond-shaped opening is extended gradually. As a result, the ticket 3 is separated from ticket 3' of the ticket sheet 1.

However, a problem encountered with this prior art apparatus is that the ticket 3 is not always cut completely along the perforations 2. Consequently, it sometimes occurs that a scrap of paper is left on both edges of the separated ticket 3 although the center part of the perforations 2 has been cut clearly. If a scrap of paper is left in an edge of the separated ticket 3, it may become jammed in a feed passage of the ticket issuing apparatus. Also, the ticket may not have a neat appearance which could cause a customer to question whether it is genuine.

SUMMARY OF THE INVENTION

Accordingly, it is an object of the present invention to provide a ticket issue apparatus which issues a high quality ticket cut with precision from a ticket sheet.

Another object of the invention is to provide a ticket issue apparatus which issues a ticket without jamming the apparatus.

The present invention is an apparatus for separating a ticket from a ticket sheet containing a plurality of tickets, each of the tickets being separated from an adjacent ticket by a line of perforations. The apparatus includes a cutting part having a feed passage, first and second spaced feed rollers positioned within the cutting part for conducting the ticket sheet along the feed passage, and a cutting roller positioned within the cutting part between the first and second feed rollers for cutting a ticket sheet at a line of perforations.

The cutting roller includes an axle and a surface having first and second ends surrounding a length of the axle. The surface of the cutting roller includes a central portion having a first diameter forming a first cutting edge on a circumference thereof, and further includes at least first and second outer portions. The first outer portion is located between the first end of the surface and the central portion, and the second portion is located between the second end of the surface and the central portion. Each of the first and second outer portions has a second diameter which is less than the first diameter and forms a second cutting edge which is smaller than the first cutting edge.

Drive means are provided for driving the first and second feed rollers at predetermined speeds to bring a line of perforations on the ticket sheet into engagement with the cutting edges of the cutting roller, and a controller is coupled to the drive means for controlling the speed at which each of the feed rollers is driven. The feed rollers are driven at different speeds so that parts of the ticket sheet on opposite sides of the line of perforations are pulled in opposite directions while the line of perforations is cut by the cutting edges of the cutting roller thereby separating a ticket from the ticket sheet.

BRIEF DESCRIPTION OF THE DRAWINGS

The present invention is illustrated in the drawings in which.

DETAILED DESCRIPTION OF THE PREFERRED EMBODIMENT

Figure 1:
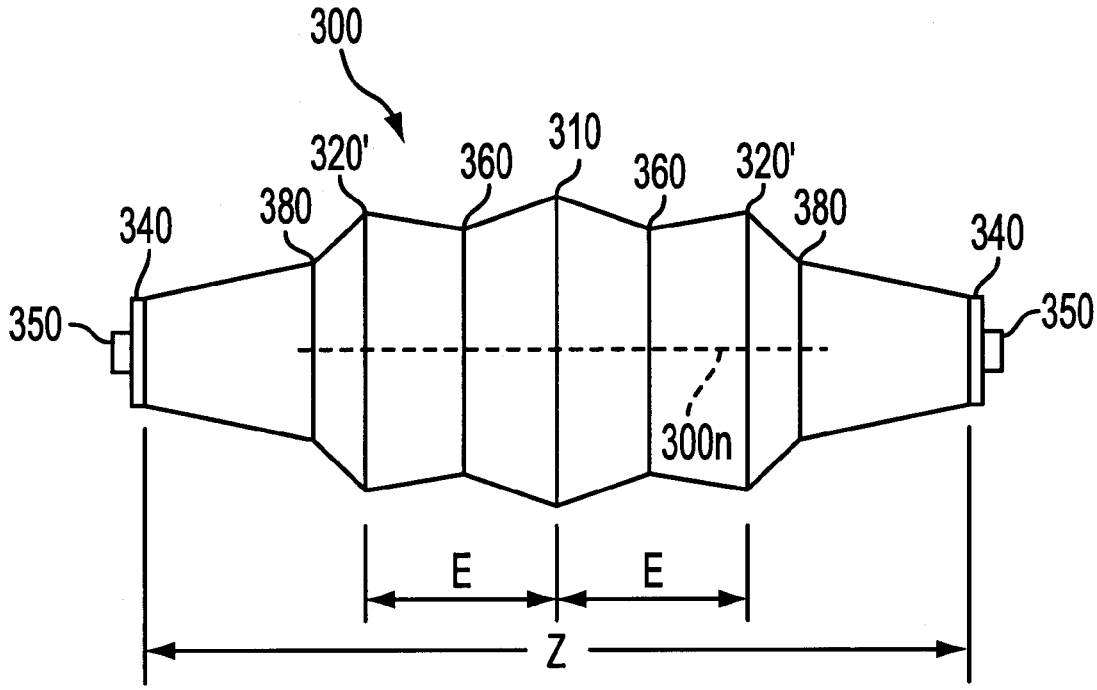
FIG. 1 is a plan view of a first embodiment of a cutting roller of the present invention.

Referring to the drawing figures, there is shown an apparatus for removing a ticket from an elongated rectangular ticket sheet consisting of a plurality of tickets separated by perforations, and for issuing a ticket to a purchaser.

Figure 2:
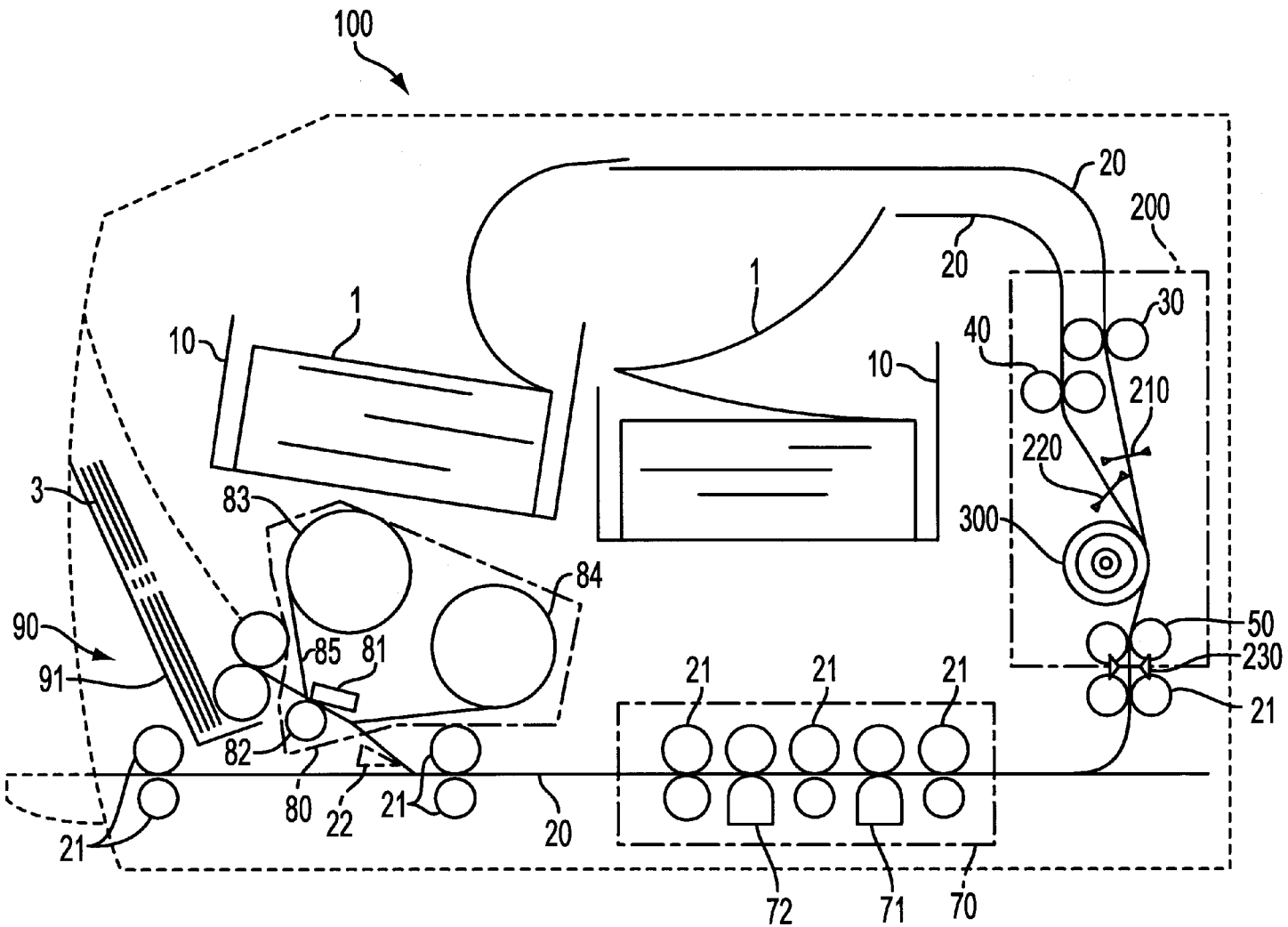
FIG. 2 is a block diagram of an apparatus for issuing a ticket which employs the cutting roller shown in FIG. 1 or FIG. 1A.
Figure 6A:
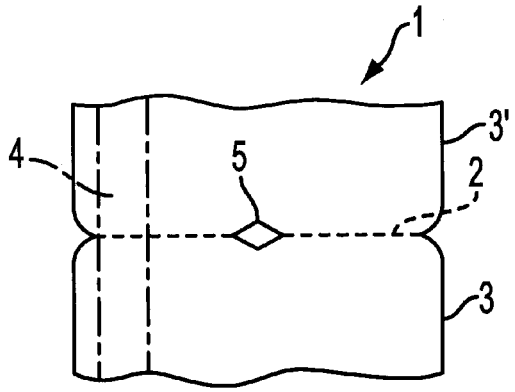
FIGS. 6A, 6B and 6C are schematic illustrations of a ticket sheet cut by the cutting roller of FIG. 1.
Figure 6B:
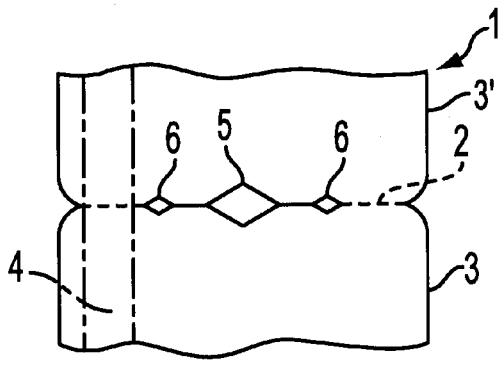
Figure 6C:
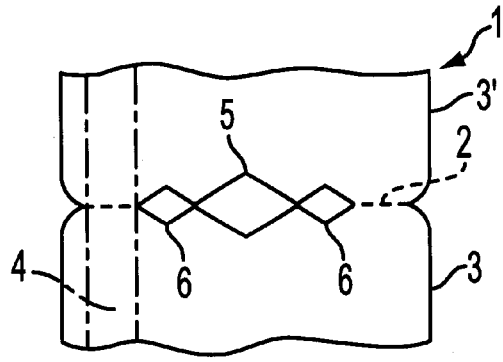
Figure 7:
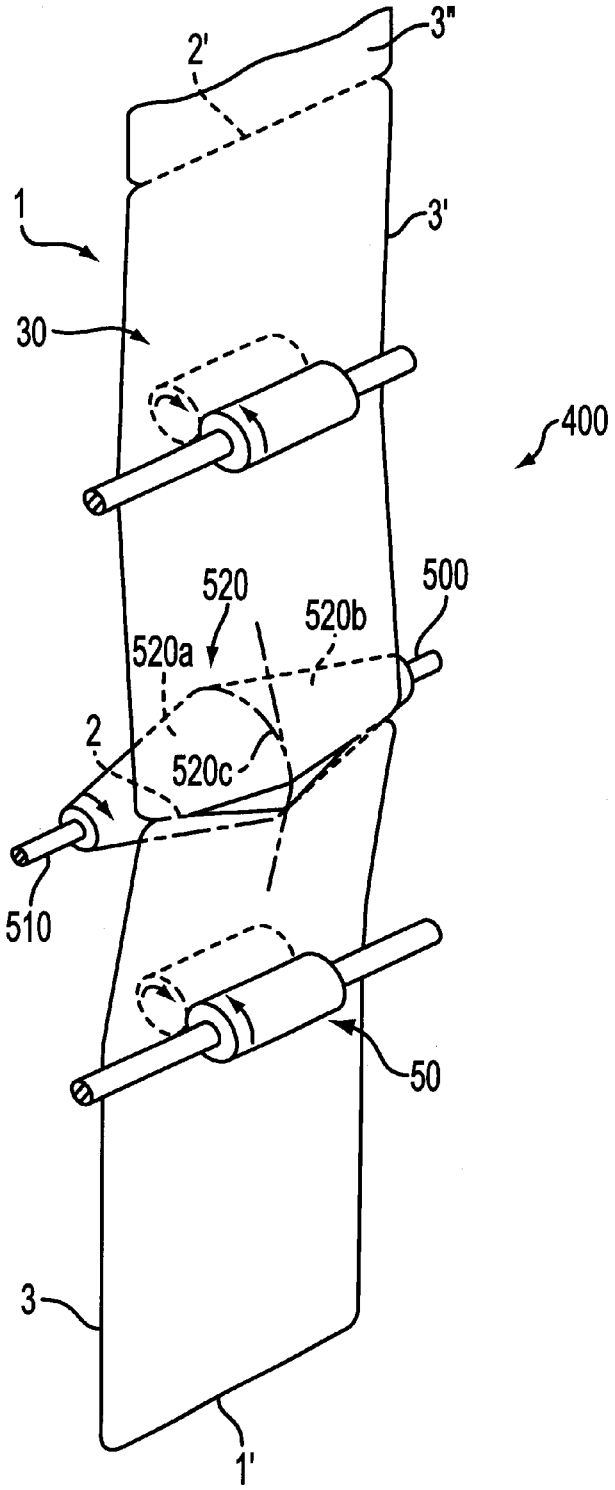
FIG. 7 (PRIOR ART)
FIG. 7 is a perspective view of the cutting portion of a prior art ticket issuing apparatus.

A ticket issue apparatus 100 (FIG. 2) for issuing a ticket 3 comprises a pair of hoppers 10 in which rectangular ticket sheets 1 folded along perforations are stored. As shown in FIG. 7, each ticket sheet 1 consists of a plurality of ticket 3, 3', 3" removably connected by perforation 2, 2'. A magnetic stripe 4 is located on the back of the ticket sheet 1 (FIGS. 6A–6C).

Figure 3:
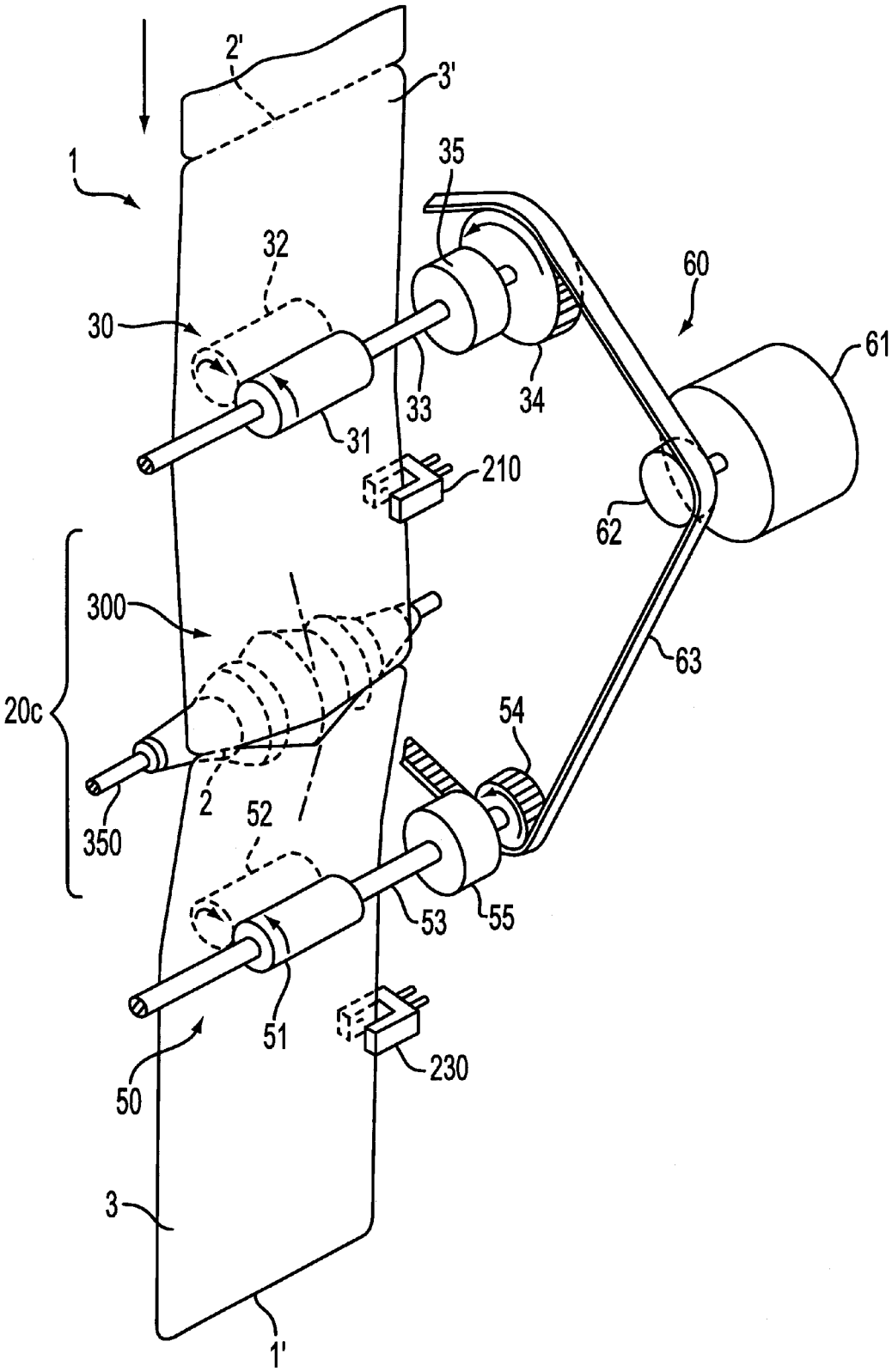
FIG. 3 is an enlarged detail view of the cutting portion of the apparatus of FIG. 2.

The apparatus 100 is provided with a plurality of feed rollers 21 distributed along a feed passage 20, and a cutting part 200. The cutting part 200 consists of a cutting roller 300, a plurality of feed means 30, 40 and 50, a drive means 60 (FIG. 3), and optical sensors 210, 220 and 230.

The cutting roller 300 (FIG. 1) is made of a hard material, for example a metal or a hard plastic, and supported rotatably by an axle 350 and metal washers 340. A first large cutting edge 310 is formed on the circumference of the central portion of the surface of the cutting roller 300, and second smaller cutting edges 320' are formed on the circumference of the roller on each side of the large edge 310. The diameters of the two small edges 320' are less than the diameter of the large edge 310, and are larger than the diameters of the cutting roller 300 adjacent the washers 340. Further, the distance E between the large edge 310 and each of the small edges 320' is one-quarter of the distance Z between the ends of the roller 300, as described by the equation E=Z/4. Also, the diameter of the roller 300 at intermediate portions 360 is less than the diameters of the rollers at cutting edges 310 and 320', and the diameter of roller 300 at outer portions 380 is less than the diameters at intermediate portions 360.

Figure 1A:
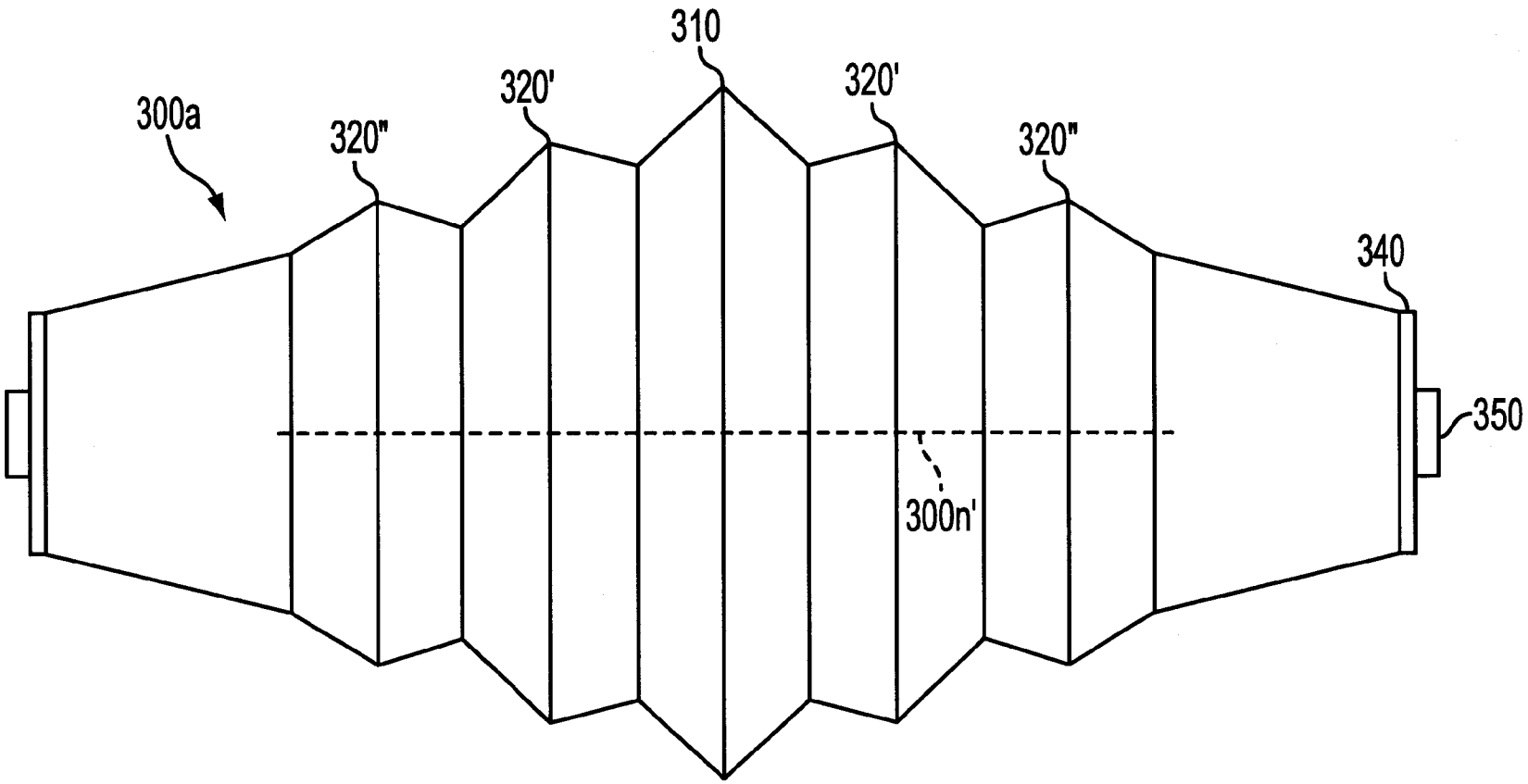
FIG. 1A is a plan view of a second embodiment of a cutting roller of the present invention.

FIG. 1A illustrates another embodiment of the cutting roller 300*a* having third cutting edges 320" formed on the circumference of the roller between the second cutting edges 320' and the metal washers 340. The diameters of the third cutting edges 320" of FIG. 1A are less than the diameters of the second cutting edges 320'.

Figure 4:
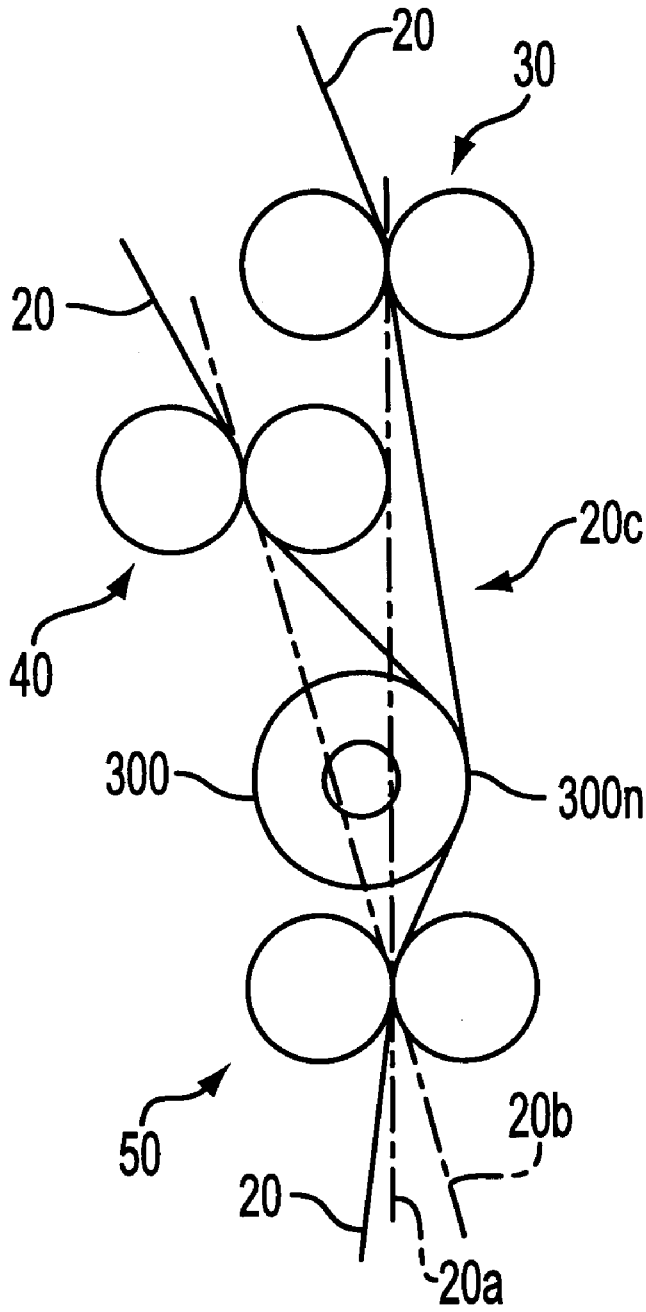
FIG. 4 is a side schematic view of the cutting portion of the apparatus of FIG. 2.

The drive means 60 (FIG. 3) consists of a drive motor 61, a pulley 62 and a toothed belt 63. The feed-means 30 and 40 are mounted in the feed passage 20 (FIG. 2) at the upstream side of the cutting roller 300, and the feed means 50 is mounted in the feed passage 20 at the downstream side of the cutting roller 300. Referring to FIG. 4, it is seen that the cutting roller 300 is positioned on a dashed line 20*a* extending between feed means 30 and feed means 50, and also on a dashed line 20*b* extending between feed means 40 and feed means 50. Consequently, the feed passage 20 has an inverted V-shape 20*c* at the cutting portion 200 of the apparatus.

The feed means 30 (50) consists of a roller shaft 33 (53), a drive roller 31 (51), an idle roller 32 (52), a toothed pulley 34 (54), and a clutch 35 (55). The pulley 34 (54) and the clutch 35 (55) are provided on the end of the roller shaft 33 (53). The sheet ticket 1 can be conveyed positively without slippage by the drive roller 31 (51) because the surface of the drive roller 31 (51) has a rubber coating. A strong torque is exerted on the pulley 34 (54) by the belt 63 since the teeth on the pulley 34 (54) are engaged with the teeth on the belt 63. The radius of the pulley 54 is smaller than the radius of the pulley 34. As a result, in this embodiment, the rotational speed of the drive roller 51 is twice the rotational speed of the drive roller 31.

Figure 5:
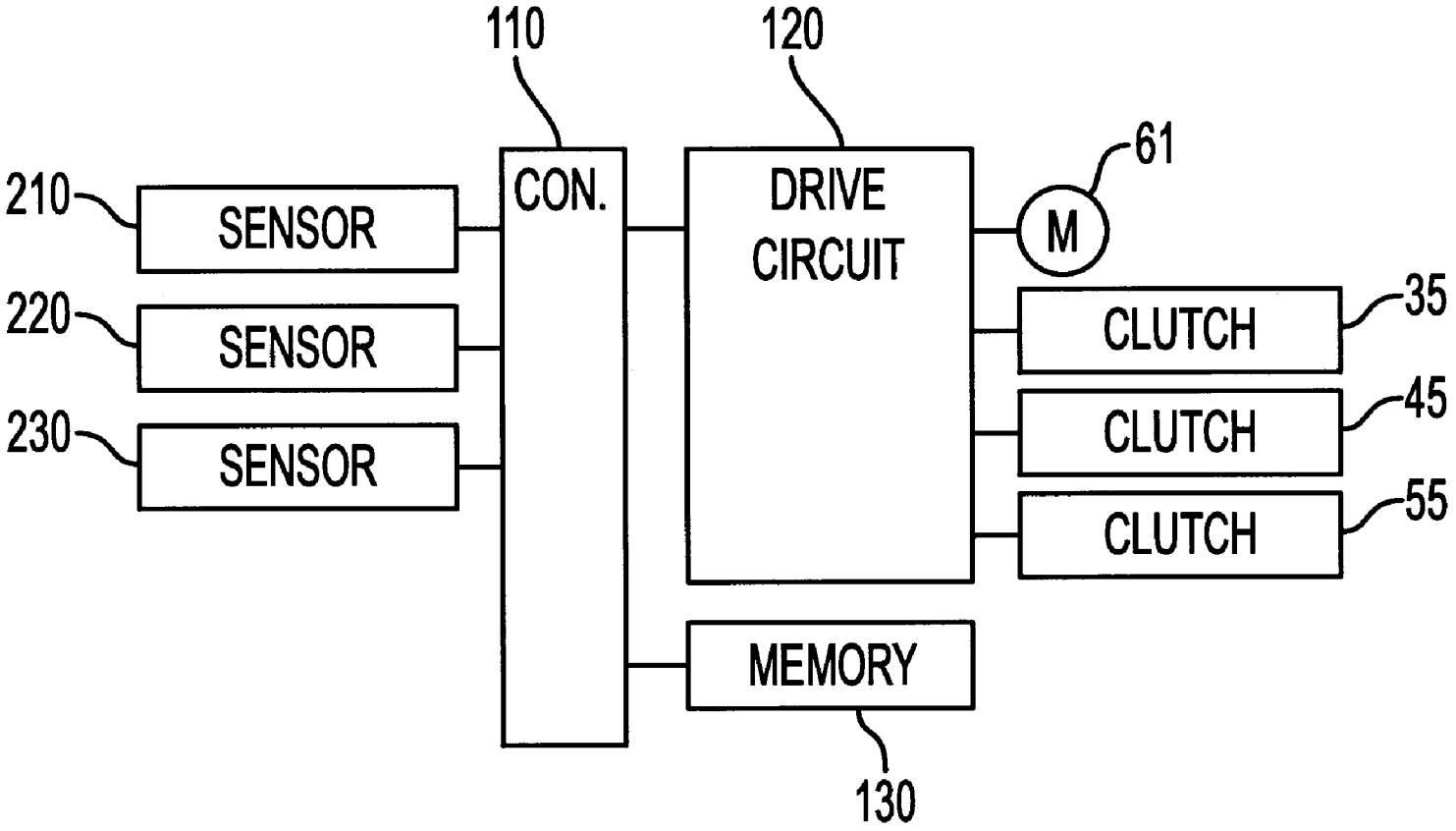
FIG. 5 is a block schematic diagram of a system for controlling the apparatus of FIG. 2.

The feed means 40 (FIG. 2) has a structure which is similar to that of the feed means 30, and includes a clutch 45 (See FIG. 5). Accordingly, a detailed description of feed means 40 is omitted.

Optical sensors 210, 220 and 230 are provided in the feed passage 20 to detect the leading edge 1' of the ticket sheet 1. The optical sensor 210 (220) is located in feed passage 20 between the feed means 30 (40) and the cutting roller 300, and the optical sensor 230 is located in feed passage 20 downstream from the feed means 50. When the optical sensor 210 (220) detects the leading edge 1' of the ticket sheet 1, the sensor 210 (220) transmits a trigger signal for measuring the distance over which the ticket sheet 1 has been conveyed. The sensor 230 transmits a signal for detecting the length of the separated ticket 3. Further, a guide plate (not shown) is provided at the cutting portion 200 to guide the ticket sheet 1 and the separated ticket 3 along the feed passage 20.

The separated ticket 3 is then conveyed to a magnetic processing part 70 which comprises a writing magnetic head 71 and a reading magnetic head 72. The writing magnetic head 71 writes magnetic data, for example the type of airplane and the flight time, on the magnetic stripe 4 of the ticket 3. The magnetic data written on the magnetic stripe 4 is read by the reading magnetic head 72 and checked. A blade 22 guides the ticket 3 after it has passed through the magnetic processing part 70 to a stacker unit 90 via a printer 80.

The printer 80 consists of a thermal head 81, a platen 82, a winding reel 83, a rewinding reel 84 and a ribbon 85. The ribbon 85 is wound on the winding reel 83 from the rewinding reel 84 and passes between the thermal head 81 and the platen 82. Customer information, for example the customer's name and passport number, is printed on the ticket 3 at the printer 80. The ticket 3 is discharged into a stacker 91 of the stacker unit 90 so that it is supported by the stacker 91.

Referring to FIG. 5, a controller 110 controls the ticket issue apparatus 100, and is connected to a drive circuit 120, a memory 130 and optical sensors 210, 220 and 230. The drive circuit 120 connects the drive motor 61 and the clutches 35, 45 and 55 for driving the feed means 30, 40 and 50 respectively. Instructions related to the length of the ticket 3 and the switching times of the clutches 34, 45 and 55 are stored in the memory 130.

An explanation as to how a ticket 3 is separated from the ticket sheet 1 and then issued follows. A cover (not shown) of the ticket issuing apparatus 100 is opened, and the ticket sheet 1 folded along its perforation is placed in one of the hoppers 10. The leading edge 1' of the ticket sheet 1 is inserted between the drive and idle rollers 31 and 32, and the cover closed. After the cover is closed, the drive motor 61 is energized. The rotation power of the drive motor 61 is conducted to the roller shaft 33 through the pulley 34 by the belt 63, the clutch 35 being engaged by command of the controller 110 thereby causing the drive roller 31 to rotate and feed the ticket sheet 1 along the feed passage 20. The rotation power of the drive motor 61 is not conducted to the roller shaft 53 because clutch 55 is not engaged. When the leading edge 1' of the ticket sheet 1 is detected by the optical sensor 210, drive motor 61 is stopped and the apparatus 100 is placed in a stand-by mode in which it waits for a command to issue a ticket.

When an operator provides the command to issue a ticket from an operation panel (not shown), the clutch 35 is engaged by a command transmitted from the controller 110, the clutch 55 is not engaged and the drive motor 61 is energized. As a result, the ticket sheet 1 is conveyed along the inverted V-shape 20*c* of the feed passage 20 toward the cutting roller 300. When the leading edge of the ticket sheet 1 reaches the feed means 50 after passing the cutting roller 300, clutch 35 is disengaged and clutch 55 is engaged by the controller 110. Then, the ticket sheet 1 is moved with twice the velocity with which it was conveyed by the drive roller 31 because the ticket sheet 1 is now being conveyed by the drive roller 51.

The ticket sheet 1 is supported by the two feed means 30, 50 and is bent by the large edge 310 of the cutting roller 300. When a predetermined time has elapsed after the leading edge of the ticket sheet 1 has been detected by the optical sensor 230, the clutch 35 is engaged and the drive roller 31 is driven by the motor 61. At this time, the perforations 2 of the ticket sheet 1 are facing a contact line 300*n* (FIGS. 1 and 4) of the cutting roller 300, or line 300*n*' if the cutting roller 300*a* of FIG. 1A is employed. As a result, since the rotation speed of the drive roller 51 is twice the rotation speed of the drive roller 31, the ticket sheet 1 is pulled upward and downward by the two rollers 31, 51. Consequently, the ticket 3 is separated from the ticket 3' of the ticket sheet 1.

Referring to FIGS. 6A–6C, the mechanism for separating ticket 3 from the ticket sheet 1 will be explained. As mentioned above, there is a difference in the rotational speeds of the drive rollers 31 and 51. In separating the ticket 3 from the ticket 3' of the ticket sheet 1, the large edge 310 of the cutting roller 300 first cuts into the perforations 2 separating ticket 3 from ticket 3', and a small diamond-shaped opening 5 is made in the center of the perforations 2 (FIG. 6A). Then, the small edges 320' of the cutting roller 300 cut into the perforations 2, and small diamond-shaped openings 6 are made on both sides of the opening 5 (FIG. 6B). The pulling power is increased and the perforations 2 between the opening 5 and openings 6 are cut, and then the perforations 2 on both sides of the ticket sheet 1 are cut (FIG. 6C). As a result, ticket 3 is separated from the ticket 3' of ticket sheet 1.

The separated ticket 3 is conveyed to the magnetic processing part 70 by the feed rollers 21 and boarding information is written in the magnetic stripe 4 of the ticket 3 by the writing magnetic head 71. Next, after the boarding information is read by the reading magnetic head 72 and checked, the ticket 3 is conveyed to the printer 80 through the blade 22. The thermal head 81 writes customer information on the ticket 3 and the ticket 3 is discharged to the stacker 91.

If another ticket is then issued, this procedure is repeated. If another ticket is not issued soon, the clutch 55 is disengaged and the clutch 35 engaged. The drive motor 61 is driven in reverse and the leading edge 1' of the ticket sheet 1 returned to the position of the optical sensor 210.

While the invention has been particularly shown and described with reference to preferred embodiments thereof, it will be understood by those skilled in the art that the foregoing and other changes in form and details can be made therein without departing from the sprit and scope of the invention. Although a boarding ticket has been used as an example in the present embodiment, the ticket could be for passage on a boat or for admission to a theatrical event. In addition, although the rotation speed of the drive roller 51 is twice as fast as the rotation speed of the drive roller 31 in this embodiment, the rotation of drive roller 31 may be stopped when the ticket is removed.

We claim:

1. In combination with a ticket sheet containing a plurality of tickets, an apparatus for separating a ticket from the ticket sheet, each of said tickets being separated from an adjacent ticket by a line of perforations, comprising:

first and second spaced feed rollers for conducting said ticket sheet along a feed passage;

a cutting roller positioned between said first and second feed rollers for cutting said ticket sheet at said line of perforations, said cutting roller including an axle, and a surface having first and second ends surrounding a length of said axle, the surface of said cutting roller including a central portion having a first diameter, said central portion forming a first cutting edge on a circumference thereof, said first cutting edge being formed so that said first cutting edge cuts into said line of perforations to make a first opening in the center of said line of perforations when said line of perforations faces the cutting roller; and first and second outer portions, said first portion being located between the first end of said surface and said central portion and said second portion being located between the second end of said surface and said central portion, each of said first and second outer portions having a second diameter which is less than said first diameter and which forms a second cutting edge which is smaller than said first cutting edge, said second cutting edges being formed so that said second cutting edges cut into said line of perforations to make second openings on both sides of said first opening when said line of perforations faces the cutting roller;

drive means for driving said first and second feed rollers at predetermined speeds to bring a line of perforations on said ticket sheet into engagement with the cutting edges of said cutting roller; and a controller coupled to said drive means for controlling the speed at which each of said feed rollers is driven, said feed rollers being driven at different speeds so that parts of said ticket sheet on opposite sides of said line of perforations are pulled in opposite directions while said first cutting edge of said cutting roller first cuts into said line of perforations to make said first opening in the center of said line of perforations, and then said second cutting edges of said cutting roller cut into said line of perforations to make said second openings on both sides of said first opening in the center of the line of perforations, thereby separating said ticket from said ticket sheet.

2. The combination according to claim 1, wherein the distance E between the first cutting edge and a second cutting edge of said cutting roller is about one-fourth the distance between the first and second ends of said surface.

3. The combination according to claim 1, wherein the cutting roller is made of a hard plastic.

4. The combination according to claim 1, wherein a plurality of said second cutting edges is provided on each side of said first cutting edge.

5. The combination according to claim 4, wherein the diameters of said second cutting edges decrease as their distance from said large cutting edge increases.

6. The combination according to claim 1, wherein said drive means drives said first feed roller at a speed which is less than the speed at which said second feed roller is driven.

7. The combination according to claim 6, wherein said second feed roller is driven at about twice the speed of said first feed roller.

8. The combination according to claim 1, wherein said first cutting edge has a generally V-shaped peak, and where said second cutting edges also have generally V-shaped peaks.

9. The combination according to claim 8, wherein said cutting roller is rotatable, with said first cutting edge and second cutting edges rotating in unison.

10. The combination according to claim 9, wherein said cutting roller comprises a unitary element having said first cutting edge and said second cutting edges.

11. The combination according to claim 1, wherein said cutting roller comprises a unitary element having said first cutting edge and said second cutting edges.

* * * * *